US010786077B2

(12) United States Patent
Dudley

(10) Patent No.: US 10,786,077 B2
(45) Date of Patent: Sep. 29, 2020

(54) CLIP HANGER

(71) Applicant: Eric Dudley, Palm Harbor, FL (US)

(72) Inventor: Eric Dudley, Palm Harbor, FL (US)

( * ) Notice: Subject to any disclaimer, the term of this patent is extended or adjusted under 35 U.S.C. 154(b) by 0 days.

(21) Appl. No.: 16/178,258

(22) Filed: Nov. 1, 2018

(65) Prior Publication Data

US 2020/0138188 A1 May 7, 2020

(51) Int. Cl.
*A47B 61/00* (2006.01)
*A47G 25/10* (2006.01)

(52) U.S. Cl.
CPC ..... *A47B 61/003* (2013.01); *A47G 25/10* (2013.01)

(58) Field of Classification Search
CPC ..... A47B 61/003; A47B 61/04; A47G 25/10; A47G 25/08; A47G 25/005; A47G 25/0614; A47G 25/0621; A47G 25/0685
USPC ..... D6/323; 211/113, 118
See application file for complete search history.

(56) References Cited

U.S. PATENT DOCUMENTS 2,508,527 A * 5/1950 Martin ..... A47G 25/08 108/152
D191,874 S * 12/1961 Yegge ..... D6/556
D365,236 S * 12/1995 Stockwell ..... D6/513
D377,123 S * 1/1997 Hutchens ..... D6/323
5,598,956 A * 2/1997 Schenberg ..... B60R 7/10 223/1
5,894,940 A * 4/1999 Gusdorf ..... A47B 57/425 211/103
6,158,593 A * 12/2000 Olsen ..... A63B 47/00 211/14
D440,144 S * 4/2001 Todd ..... D8/354
6,854,610 B2 * 2/2005 Adams ..... A47G 25/0614 211/118
7,178,769 B2 * 2/2007 Magnusson ..... A47B 96/1416 211/119.004
D647,327 S * 10/2011 Levin ..... D6/323
D647,328 S * 10/2011 Levin ..... D6/323
D654,639 S * 2/2012 Huber ..... D30/153
D657,054 S * 4/2012 Bacon ..... D24/128
8,387,934 B2 * 3/2013 Nally ..... F16B 2/22 211/113
D707,456 S * 6/2014 Farias, Jr. ..... D6/323
8,783,475 B2 * 7/2014 Carver ..... A47G 25/08 211/113
D771,960 S * 11/2016 McDonough ..... D6/328
D789,032 S * 6/2017 Robinson ..... D2/623
2004/0173550 A1 * 9/2004 Adams ..... A47G 25/0614 211/118

(Continued)

*Primary Examiner* — Patrick D Hawn

(57) ABSTRACT

A clothing organizer and storage apparatus that allows for clothes to be mounted to a door or a wall for storage. The apparatus includes a first door hook, a second door hook, an elongated strap, and at least one attachment assembly. The first door hook and the second door hook are each terminally attached to the elongated strap and attach to an external structure. The attachment assembly includes a strap buckle, a ring, and a clothes clip to attach and suspend clothing along the elongated strap. The attachment assembly is positioned along the elongated strap with the elongated strap being threaded through the strap buckle. The ring is pivotably and adjacently connected to the strap buckle for additional degree of freedom. The clothes clip is removably mounted to the ring and acts as the grasping element for holding clothing.

17 Claims, 4 Drawing Sheets

(56) References Cited

U.S. PATENT DOCUMENTS

| | | | | |
|---|---|---|---|---|
| 2006/0207956 | A1* | 9/2006 | Sivers | A47G 29/00 211/113 |
| 2007/0193969 | A1* | 8/2007 | Albanese | A47F 5/01 211/85.2 |
| 2007/0205168 | A1* | 9/2007 | Helvey | A47F 5/0884 211/85.28 |
| 2014/0021152 | A1* | 1/2014 | Carver | A47G 25/08 211/85.3 |
| 2015/0376826 | A1* | 12/2015 | Fogg | A47G 25/68 223/61 |
| 2018/0142833 | A1* | 5/2018 | Sasson | A47G 25/06 |

* cited by examiner

CLIP HANGER

FIELD OF THE INVENTION

The present invention relates generally to a modularly assignable rack that may be outfitted to a door or wall and possess a plurality of clips for holding a variety of articles, specifically hats.

BACKGROUND OF THE INVENTION

The present invention is a storage and organizer for clothing articles on a door. The present invention vertically attaches to a door in order to utilize the space directly behind a door for storage. Additionally, the present invention may be attached to the front of a door, the rear of a door, and a wall. Specifically, the present invention is designed for hanging and storing baseball caps so as to not damage or ruin the baseball cap's form. Traditional means for storing baseball caps require a lot of space so to ensure no weight is pressed onto the caps, as this will deform and ruin the profile of the cap. The present invention overcomes this problem by utilizing the space directly behind a door. Additionally, the present apparatus allows for the attachment of multiple clips to suit multiple articles such as hats, shoes, shirts, and so on.

DETAIL DESCRIPTIONS OF THE INVENTION

All illustrations of the drawings are for the purpose of describing selected versions of the present invention and are not intended to limit the scope of the present invention.

The present invention generally relates to an apparatus for storing and organizing clothing articles. Specifically, the present invention is a storage rack for storing and organizing hats. The present invention attaches to and extends along a door. Although, the present invention may also be used to storing and organizing other articles of clothing including, but not limited to, shoes, shirts, ties, and sweaters.

Figure 1:
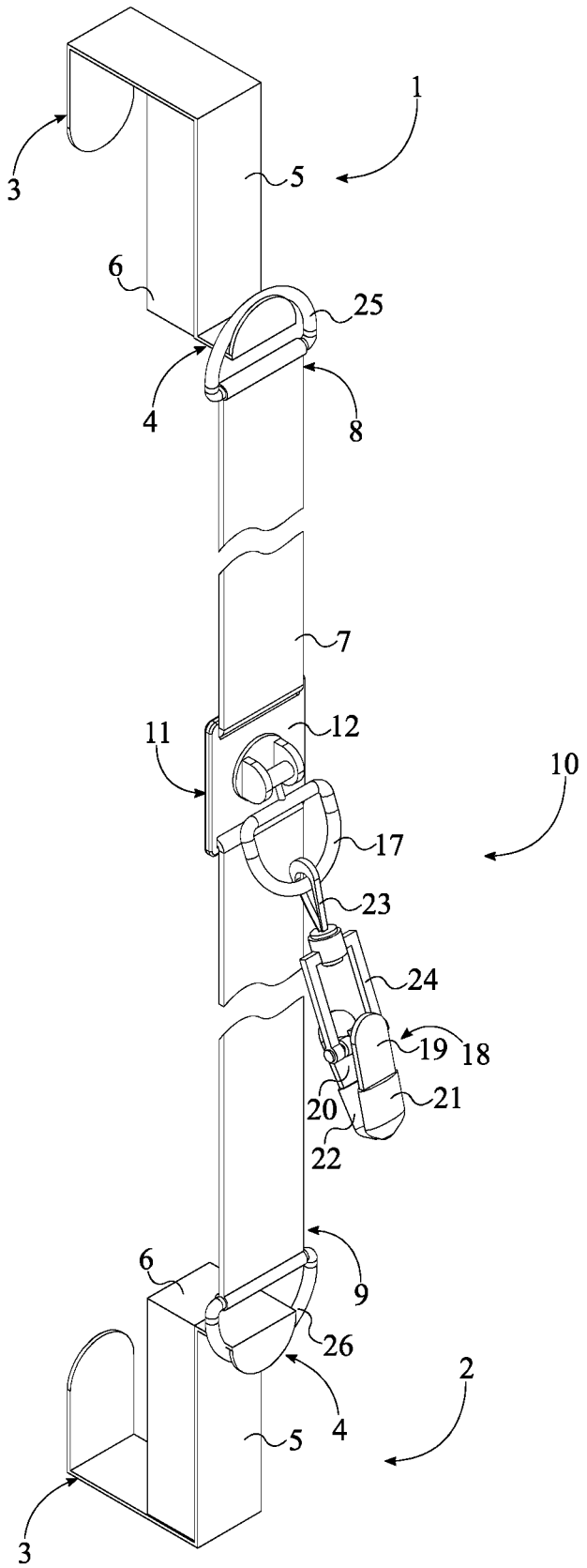
FIG. 1 is a perspective view of the present invention.
Figure 4:
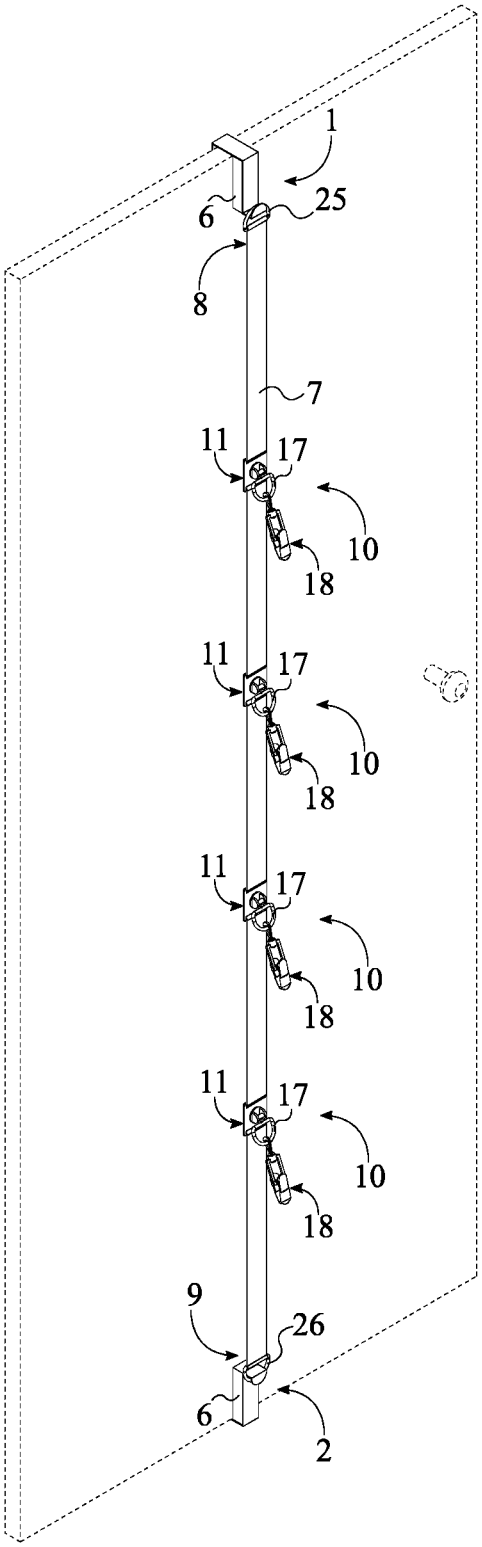
FIG. 4 is a perspective view of the present invention attached to a door.

Referring to FIG. 1, the present invention comprises a first door hook 1, a second door hook 2, an elongated strap 7, and an at least one attachment assembly 10. The first door hook 1 and the second door hook 2 attach and secure the present invention to a door in a vertical orientation, i.e. along the length of the door. The elongated strap 7 acts as the support structure for the attachment assembly 10 and allows the present invention to be stored and transported in a rolled-up state. The elongated strap 7 is composed of a poly webbing or textile material but may also be produced of rubber, organic materials, thin planar metal sheets, and so on. The elongated strap 7 is preferably adjustable in length such that the present invention may mount to a variety of external structures. Referring to FIG. 4, the first door hook 1 and the second door hook 2 are each an over-the-door hook that clip over and onto a door to support and suspend the elongated strap 7. Specifically, the first door hook 1 is terminally attached to the elongated strap 7. Similarly, the second door hook 2 is terminally attached to the elongated strap 7, opposite the first door hook 1. To attach the present invention to a door, the first door hook 1 and the second door hook 2 are simply positioned over the door body with the first door hook 1 and the second door hook 2 being positioned opposite to each other along the door. To ensure that the present invention stays fixed to the door, the elongated strap 7 is preferably adjustable in length and, thus, is configured in a taught state when the present invention is attached to a door.

The attachment assembly 10 grips and holds an article of clothing at a specific height on the elongated strap 7 and, in the simplest embodiment, comprises a strap buckle 11, a ring 17, and an at least one clothes clip 18. Referring to FIG. 1 and FIG. 4, the attachment assembly 10 is positioned along the elongated strap 7, in between the first door hook 1 and the second door hook 2. The positioning of the attachment assembly 10 on the elongated strap 7 determines the vertical height at which the attachment assembly 10 is held. The strap buckle 11 is a strap, belt, or string fastening device. The strap buckle 11 attaches the attachment assembly 10 to the elongated strap 7 and allows a user to adjust the relative height of the attachment assembly 10 to meet his or her needs and preferences. For this, the elongated strap 7 is threaded through the strap buckle 11. The ring 17 is preferably a D-shaped rigid structure that acts as an intermediate coupling element in between the strap buckle 11 and the clothes clip 18. The ring 17 is pivotably and adjacently connected to the strap buckle 11. This allows the clothes clip 18 to pivot and swivel towards and away from the elongated strap 7 to accommodate the size of the attached clothing article. The clothes clip 18 grips and suspends a portion of a clothing article. The clothes clip 18 is positioned adjacent to the ring 17 and is removably mounted to the ring 17. The present invention is optimized for organizing and storing hats, specifically baseball caps. For this, a baseball cap is attached to the present invention by clamping a brim of the baseball cap with the clothes clip 18.

Figure 3:
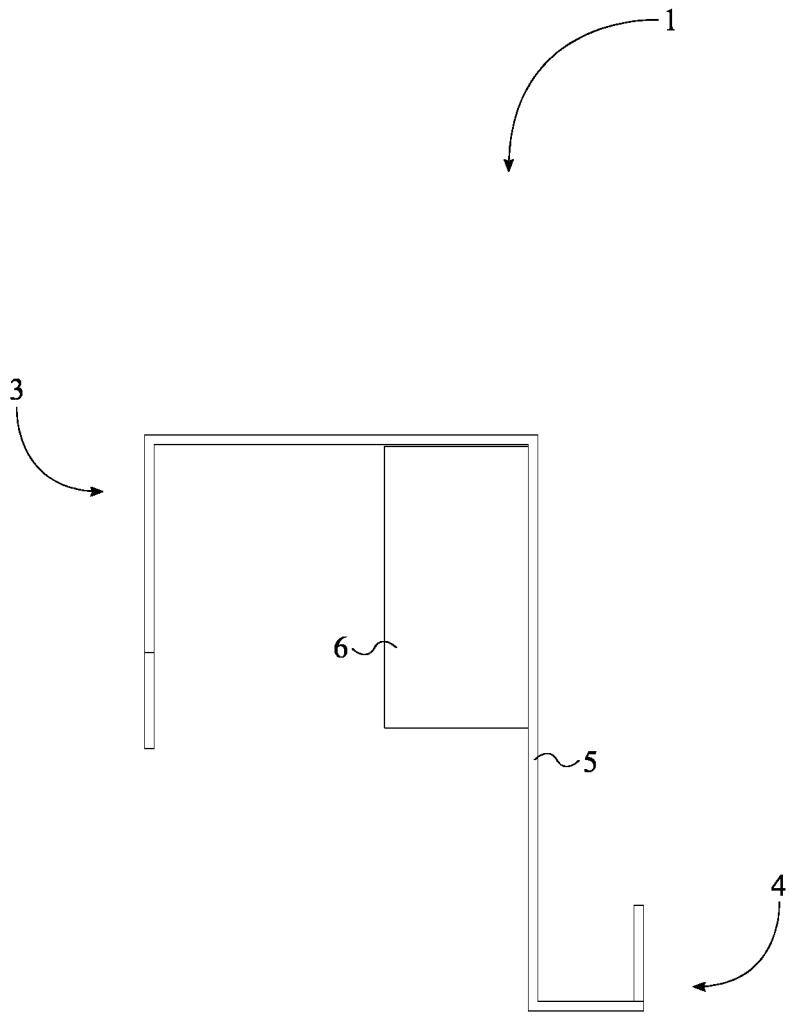
FIG. 3 is a side elevation view of a first door hook.

Referring to FIG. 3, the first door hook 1 and the second door hook 2 each further comprise a first L-shaped plate 3, a second L-shaped plate 4, a connecting plate 5, and an at least one spacer pad 6. The first L-shaped plate 3 and the second L-shaped plate 4 are each an elongated thin and metallic rigid structure that is bent into an L-shape. The first L-shaped plate 3 hooks over the door while the second L-shaped plate 4 attaches to the elongated strap 7. The connecting plate 5 connects the first L-shaped plate 3 to the second L-shaped plate 4. Specifically, the first L-shaped plate 3 and the second L-shaped plate 4 are positioned opposite to each other along and across the connecting plate 5. Additionally, the first L-shaped plate 3 and the second L-shaped plate 4 are oriented towards each other as seen in FIG. 3. Furthermore, the connecting plate 5 is perpendicularly connected in between the first L-shaped plate 3 and the second L-shaped plate 4. This configuration forms two hook-shaped features, a first hook for the door and a second hook for the elongated strap 7. The first hook is placed over the door for attachment of the present invention to the door. The spacer pad 6 is a block of padded material that allows the first hook to fit doors with different thicknesses as well as protect the outer surface of a door from scratches and abrasions. The spacer pad 6 may be composed of material including, but not limited to, foam, rubber, gels, and plastic to name a few non-limiting examples. The spacer pad 6 is mounted in between the first L-shaped plate 3 and the connecting plate 5 to laterally press against the door surface. In one embodiment of the present invention, the spacer pad 6 is adjacently connected to the connecting plate 5. In another embodiment of the present invention, the spacer pad 6 is adjacently connected to a vertical leg of the first L-shaped plate 3. In yet another embodiment, the at least one spacer pad 6 comprises a first pad and a second pad. In this embodiment, both sides of the door are protected; for this, the first pad is adjacently connected to the connecting plate 5, and the second pad is adjacently connected to the first leg of the first L-shaped plate 3. The spacer pad 6 may be affixed through any number of means such as conventional fasteners and self-orienting means, however, adhesive is preferred.

The elongated strap 7 attaches to the first door hook 1 and the second door hook 2 through a first D-shaped ring 25 and a second D-shaped ring 26. Specifically, the first D-shaped ring 25 is adjacently connected to a first end 8 of the elongated strap 7. Similarly, the second D-shaped ring 26 is adjacently connected to a second end 9 of the elongated strap 7. The first D-shaped ring 25 and the second D-shaped ring 26 are each sized with a diameter larger than a width of the second L-shaped plate 4 of the first door hook 1 and the second L-shaped plate 4 of the second door hook 2, respectively. This allows the elongated strap 7 to attach and detach to the first door hook 1 and second door hook 2 easily and efficiently. Specifically, the second L-shaped plate 4 of the first door hook 1 is positioned within the first D-shaped ring 25. Similarly, the second L-shaped plate 4 of the second door hook 2 is positioned within the second D-shaped ring 26.

Figure 2:
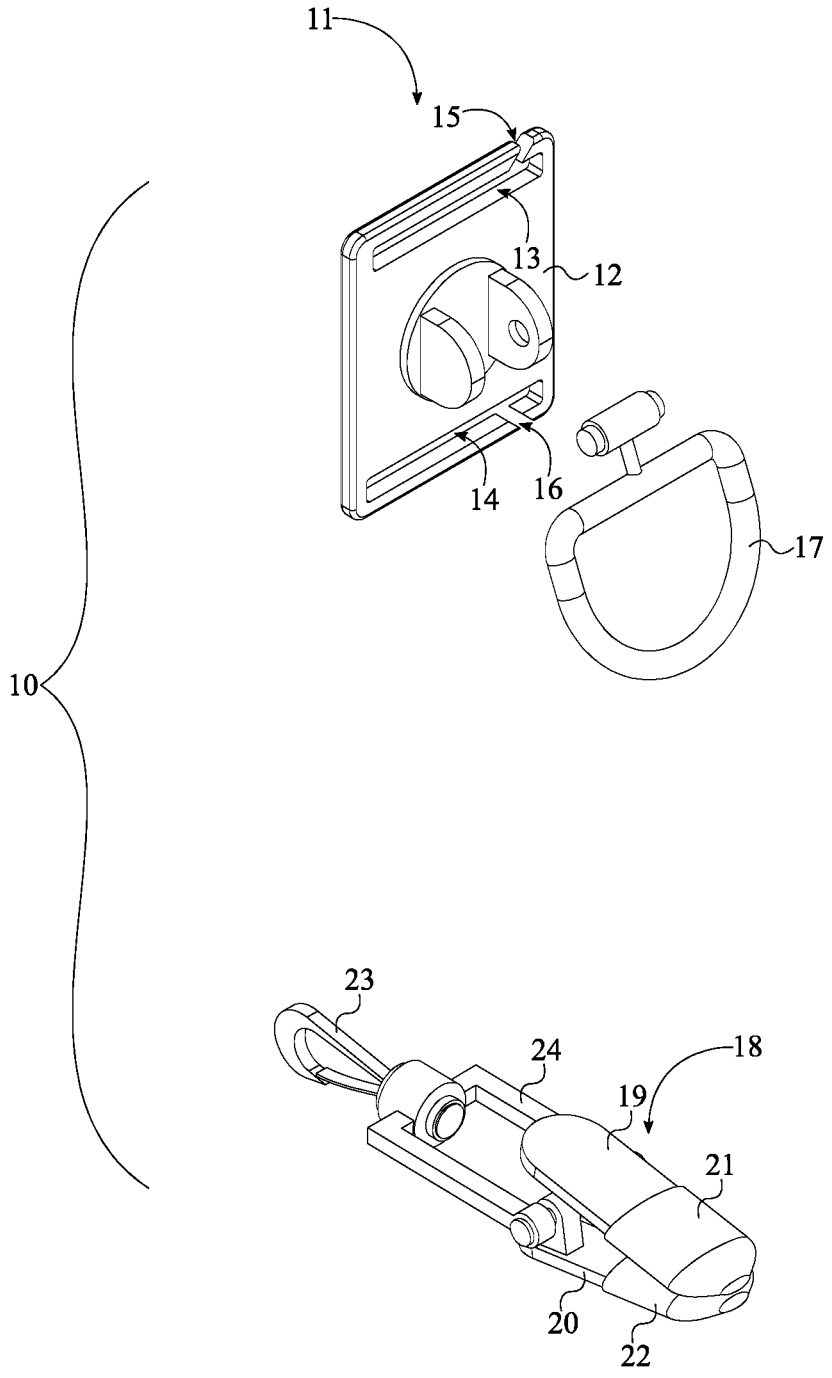
FIG. 2 is a perspective view of an attachment assembly in a partially exploded view.

Referring to FIG. 2, the strap buckle 11 comprises a plate body 12, a first strap-receiving hole 13, a second strap-receiving hole 14, a first slot 15, and a second slot 16. The plate body 12 is a thin piece of rigid material that couples the ring 17 and the clothes clip 18 to the elongated strap 7; wherein, the plate body 12 is preferably rectangular and composed of plastic material. The first strap-receiving hole 13 and the second strap-receiving hole 14 receive the body of the elongated strap 7 and allow the user to adjust the location of the strap buckle 11 on the elongated strap 7. For this, the first strap-receiving hole 13 and the second strap-receiving hole 14 are each a hole with a width greater or equal to the width of the elongated strap 7. The first strap-receiving hole 13 and the second strap-receiving hole 14 are positioned opposite to each other along the plate body 12 for symmetrical support. Additionally, the ring 17 is positioned in between the first strap-receiving hole 13 and the second strap-receiving hole 14. The first strap-receiving hole 13 traverses normal and through the plate body 12. Similarly, the second strap-receiving hole 14 traverses normal and through the plate body 12. In order to attach the strap buckle 11 to the elongated strap 7, the elongated strap 7 is threaded through the first strap-receiving hole 13 and the second strap-receiving hole 14. Typical buckle designs require the user to thread the elongated strap 7 from the first end 8 towards the second end 9. In this embodiment, the first slot 15 and the second slot 16 allow for easy attachment and detachment of the attachment assembly 10. In particular, the first slot 15 and the second slot 16 allow the strap buckle 11 to attach to the elongated strap 7 directly at the desired location/height. The first slot 15 and the second slot 16 are positioned opposite to each other along the plate body 12. The first slot 15 provides a means of quickly threading the elongated strap 7 through the first strap-receiving hole 13. Thus, the first slot 15 laterally traverses into the plate body 12 and into the first strap-receiving hole 13. Similarly, the second slot 16 provides a means of quickly threading the elongated strap 7 through the second strap-receiving hole 14. Thus, the second slot 16 laterally traverses into the plate body 12 and into the second strap-receiving hole 14.

In the preferred embodiment of the present invention, the attachment assembly 10 further comprises a spring clip 23, a spacer 24, a first non-slip boot 21, and a second non-slip boot 22. The spring clip 23 is a preferably an annular body with a single gap space to allow engagement to the ring 17 by applying enough force and overcoming the gap space. The spring clip 23 provides the clothes clip 18 an additional degree of freedom in the pitch direction. Specifically, the spring clip 23 is positioned in between the ring 17 and the clothes clip 18. Additionally, the spring clip 23 is rotatably and terminally mounted to the clothes clip 18. Furthermore, the spring clip 23 is interlocked with the ring 17. The spacer 24 offsets the clothes clip 18 from the strap buckle 11. Referring to FIG. 2, the spacer 24 is positioned in between the spring clip 23 and the clothes clip 18. On one end, the spring clip 23 is rotatably and terminally connected to the spacer 24. On the other end, the clothes clip 18 is mounted to the spacer 24. In particular, a first jaw 19 of the clothes clip 18 and a second jaw 20 of the clothes clip 18 are positioned opposite to each other, across the spacer 24; wherein the first jaw 19 and the second jaw 20 are each laterally and hingedly connected to the spacer 24. The first jaw 19 and the second jaw 20 act as the gripping elements that grasp a clothing article. A tensioning mechanism is integrated in between the first jaw 19, the second jaw 20, and the spacer. The tensioning mechanism applies a continuous torque force onto the first jaw 19 and the second jaw 20 to force the first jaw 19 and the second jaw 20 to press against each other and hold a clothing article through friction, similar to traditional alligator clips. The first non-slip boot 21 and the second non-slip boot 22 are each a high-friction soft material designed to cover the clothes clip 18 and prevent any damage to a clothing article being held by the clothes clip 18. Specifically, the first jaw 19 is sleeved by the first non-slip sleeve and the second jaw 20 is sleeved by the second non-slip sleeve.

In the preferred embodiment of the present invention, referring to FIG. 4, the at least one attachment assembly 10 comprises a plurality of attachment assemblies 10 to allow the user to attach a multitude of clothing articles to the present invention. The plurality of attachment assemblies 10 is distributed along the elongated strap 7. The number within the plurality of attachment assemblies 10 and the location of each within the plurality of attachment assemblies 10 is subject to change to meet the storage needs and preferences of the user.

Although the invention has been explained in relation to its preferred embodiment, it is to be understood that many other possible modifications and variations can be made without departing from the spirit and scope of the invention.

What is claimed is:

1. A clip hanger comprising:

a first door hook;

a second door hook;

an elongated strap;

an at least one attachment assembly;

the attachment assembly comprises a strap buckle, a ring, and an at least one clothes clip;

the first door hook being terminally attached to the elongated strap;

the second door hook being terminally attached to the elongated strap, opposite the first door hook;

the attachment assembly being positioned along the elongated strap in between the first door hook and the second door hook;

the elongated strap being threaded through the strap buckle;

the ring being pivotably and adjacently connected to the strap buckle;

the clothes clip being positioned adjacent to the ring;

the clothes clip being removably mounted to the ring;

the attachment assembly further comprises a first non-slip boot and a second non-slip boot;

a first jaw of the clothes clip being sleeved by the first non-slip boot; and a second jaw of the clothes clip being sleeved by the second non-slip boot.

2. The clip hanger as claimed in claim 1 comprising:

the attachment assembly further comprises a spring clip;

the spring clip being positioned in between the ring and the clothes clip;

the spring clip being rotatably and terminally mounted to the clothes clip; and the spring clip being interlocked with the ring.

3. The clip hanger as claimed in claim 2 comprising:

the attachment assembly further comprises a spacer;

the clothes clip comprises a first jaw and a second jaw;

the spacer being positioned in between the spring clip and the clothes clip;

the spring clip being rotatably and terminally connected to the spacer;

the first jaw and the second jaw being positioned opposite to each other, across the spacer;

the first jaw being laterally and hingedly connected to the spacer; and the second jaw being laterally and hingedly connected to the spacer.

4. The clip hanger as claimed in claim 1 comprising:

an at least one attachment assembly comprises a plurality of attachment assemblies; and the plurality of attachment assemblies being distributed along the elongated strap.

5. The clip hanger as claimed in claim 1 comprising:

the strap buckle comprises a plate body, a first strap-receiving hole, and a second strap-receiving hole;

the first strap-receiving hole and the second strap-receiving hole being positioned opposite to each other along the plate body;

the first strap-receiving hole traversing normal and through plate body;

the second strap-receiving hole traversing normal and through the plate body;

the ring being positioned in between the first strap-receiving hole and the second strap-receiving hole; and the elongated strap being threaded through the first strap-receiving hole and the second strap-receiving hole.

6. The clip hanger as claimed in claim 5 comprising:

the strap buckle further comprises a first slot and a second slot;

the first slot and the second slot being positioned opposite to each other along the plate body;

the first slot laterally traversing into the plate body and into the first strap-receiving hole; and the second slot laterally traversing into the plate body and into the second strap-receiving hole.

7. The clip hanger as claimed in claim 1 comprising:

the first door hook and the second door hook each comprise a first L-shaped plate, a second L-shaped plate, and a connecting plate;

the first L-shaped plate and the second L-shaped plate being positioned opposite to each other along and across the connecting plate;

the first L-shaped plate and the second L-shaped plate being oriented towards each other; and the connecting plate being perpendicularly connected in between the first L-shaped plate and the second L-shaped plate.

8. The clip hanger as claimed in claim 7 comprising:

the first door hook and the second door hook each further comprise an at least one spacer pad; and the spacer pad being mounted in between the first L-shaped plate and the connecting plate.

9. The clip hanger as claimed in claim 7 comprising:

a first D-shaped ring;

a second D-shaped ring;

a first end of the elongated strap being adjacently connected to the first D-shaped ring;

a second end of the elongated strap being adjacently connected to the second D-shaped ring;

the second L-shaped plate of the first door hook being positioned within the first D-shaped ring; and the second L-shaped plate of the second door hook being positioned within the second D-shaped ring.

10. A clip hanger comprising:

a first door hook;

a second door hook;

an elongated strap;

an at least one attachment assembly;

the attachment assembly comprises a strap buckle, a ring, and an at least one clothes clip, and a spring clip;

the first door hook being terminally attached to the elongated strap;

the second door hook being terminally attached to the elongated strap, opposite the first door hook;

the attachment assembly being positioned along the elongated strap in between the first door hook and the second door hook;

the elongated strap being threaded through the strap buckle;

the ring being pivotably and adjacently connected to the strap buckle;

the clothes clip being positioned adjacent to the ring;

the clothes clip being removably mounted to the ring;

the spring clip being positioned in between the ring and the clothes clip;

the spring clip being rotatably and terminally mounted to the clothes clip;

the spring clip being interlocked with the ring;

the attachment assembly further comprises a first non-slip boot and a second non-slip boot;

a first jaw of the clothes clip being sleeved by the first non-slip boot; and a second jaw of the clothes clip being sleeved by the second non-slip boot.

11. The clip hanger as claimed in claim 10 comprising:

the attachment assembly further comprises a spacer;

the clothes clip comprises a first jaw and a second jaw;

the spacer being positioned in between the spring clip and the clothes clip;

the spring clip being rotatably and terminally connected to the spacer;

the first jaw and the second jaw being positioned opposite to each other, across the spacer;

the first jaw being laterally and hingedly connected to the spacer; and the second jaw being laterally and hingedly connected to the spacer.

12. The clip hanger as claimed in claim 10 comprising:

an at least one attachment assembly comprises a plurality of attachment assemblies; and the plurality of attachment assemblies being distributed along the elongated strap.

13. The clip hanger as claimed in claim 10 comprising:

the strap buckle comprises a plate body, a first strap-receiving hole, and a second strap-receiving hole;

the first strap-receiving hole and the second strap-receiving hole being positioned opposite to each other along the plate body;

the first strap-receiving hole traversing normal and through plate body;

the second strap-receiving hole traversing normal and through the plate body;

the ring being positioned in between the first strap-receiving hole and the second strap-receiving hole; and the elongated strap being threaded through the first strap-receiving hole and the second strap-receiving hole.

14. The clip hanger as claimed in claim 13 comprising:

the strap buckle further comprises a first slot and a second slot;

the first slot and the second slot being positioned opposite to each other along the plate body;

the first slot laterally traversing into the plate body and into the first strap-receiving hole; and the second slot laterally traversing into the plate body and into the second strap-receiving hole.

15. The clip hanger as claimed in claim 10 comprising:

the first door hook and the second door hook each comprise a first L-shaped plate, a second L-shaped plate, and a connecting plate;

the first L-shaped plate and the second L-shaped plate being positioned opposite to each other along and across the connecting plate;

the first L-shaped plate and the second L-shaped plate being oriented towards each other; and the connecting plate being perpendicularly connected in between the first L-shaped plate and the second L-shaped plate.

16. The clip hanger as claimed in claim 15 comprising:

the first door hook and the second door hook each further comprise an at least one spacer pad; and the spacer pad being mounted in between the first L-shaped plate and the connecting plate.

17. The clip hanger as claimed in claim 15 comprising:

a first D-shaped ring;

a second D-shaped ring;

a first end of the elongated strap being adjacently connected to the first D-shaped ring;

a second end of the elongated strap being adjacently connected to the second D-shaped ring;

the second L-shaped plate of the first door hook being positioned within the first D-shaped ring; and the second L-shaped plate of the second door hook being positioned within the second D-shaped ring.

* * * * *